US006080095A

United States Patent [19]

Chen

[11] Patent Number: 6,080,095

[45] Date of Patent: Jun. 27, 2000

[54] CARTON-SHAPING MACHINE

[75] Inventor: Tuan-Mei Chiu Chen, Chia Yi Hsien, Taiwan

[73] Assignee: Tien Heng Machinery Co., Ltd., Chia-Yi Hsien, Taiwan

[21] Appl. No.: 09/281,781

[22] Filed: Mar. 31, 1999

[51] Int. Cl.[7] ..... B31B 1/78

[52] U.S. Cl. ..... 493/309; 493/128; 493/131; 493/183

[58] Field of Search ..... 493/121, 126, 493/128, 309, 131, 437, 183, 182, 180, 479; 53/381.1, 381.7, 382.1, 563, 564

[56] References Cited

U.S. PATENT DOCUMENTS 4,213,285 7/1980 Mancini ..... 53/564

4,807,428 2/1989 Boisseau ..... 493/479

5,511,362 7/1980 Morita et al. ..... 493/183

*Primary Examiner*—Peter Vo

*Assistant Examiner*—Louis C. Huynh

*Attorney, Agent, or Firm*—Rosenberg, Klein & Lee

[57] ABSTRACT

A carton-shaping machine includes a material conveying mechanism, an opening mechanism, a shaping mechanism, and a band sticking mechanism combined on a worktable. A vertical and a horizontal cylinder of the opening mechanism control fixing members to force needles on them insert firmly in an upper folding portion of a carton and turn the carton to extend to standing position so as to permit opening process operated with accuracy. Then, the band sticking mechanism may seal the bottom portion of the carton and the carton is moved to the packing process, without any need of manual work to turn it for a right angle to stand upright.

3 Claims, 13 Drawing Sheets

CARTON-SHAPING MACHINE

BACKGROUND OF THE INVENTION

This invention relates to a carton-shaping machine, particularly to one improved in an shaping mechanism, which can operate to correctly shape a carton of an upper foldable open portion of a carton located facing up, elevating work efficiency for shaping cartons.

In various industries, products should be packaged in cartons, after they are finished. As work wage has been increasing year after year, automatic carton packaging machines have also been used instead of manual work, but still manual work is needed more or less. A known conventional carton-shaping machine operates to move cartons in a flat horizontal condition for opening and shaping. The conventional carton-shaping machine includes sucking plate units for sucking up a side portion of a flat carton to rise up for shaping a carton with a bottom side and an upper side located vertical and then the bottom side is adhered with an adhesive tape on a center contact line. However, the workplace may be full of minute dirt and the outer surface of flat horizontal cartons to be shaped may also have dirt thereon, so the sucking plates may sometimes be impossible to suck up an upper side portion of a carton, causing interruption of shaping process. In addition, when a finished carton comes out of the conventional shaping machine, it stands on one of the side portions, not on the bottom side, so the finished carton has to be turned for 90 degrees to let the bottom side stand on a table or on the ground and the upper open side facing up for placing product therein. Thus, the conventional carton-shaping machine has disadvantages to be improved.

SUMMARY

This invention has been devised to offer a carton-shaping machine improved in the disadvantage in the conventional carton-shaping machine described above.

The main feature of the invention is an opening mechanism having a vertical and a horizontal control cylinder for controlling fixing members provided with needle bases for extending a flat carton in the vertical condition so that opening operation may be effected correctly, without need of any manual work in the whole shaping process. Then, cartons may be moved onto a packaging process line, with no need of turning over to change their position for packing.

BRIEF DESCRIPTION OF THE DRAWINGS

This invention will better understood by reference to the accompanying drawings, wherein.

DETAILED DESCRIPTION OF THE PREFERRED EMBODIMENT

Figure 1:
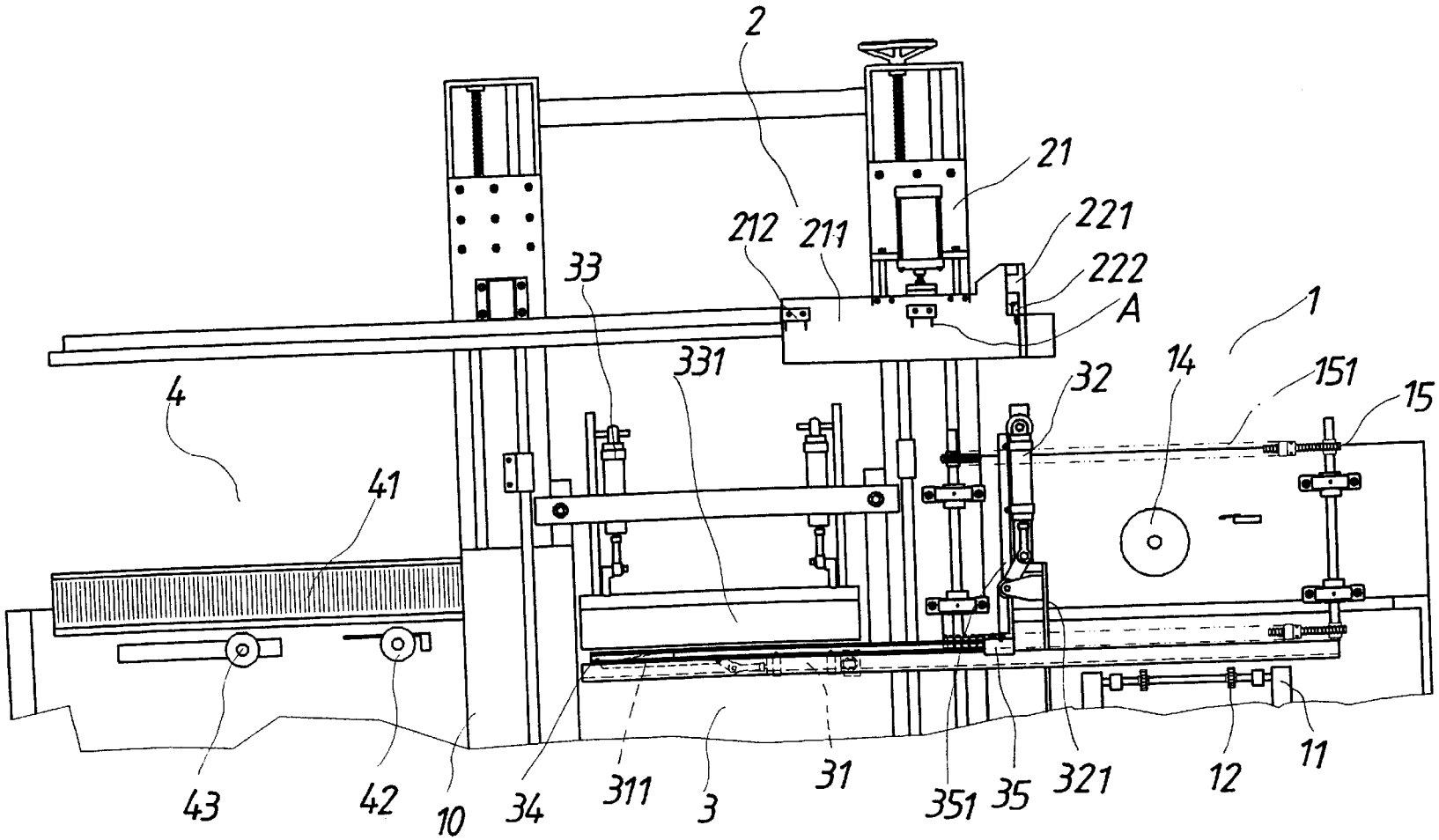
FIG. 1 is a front view of a carton-shaping machine of the present invention.
Figure 2:
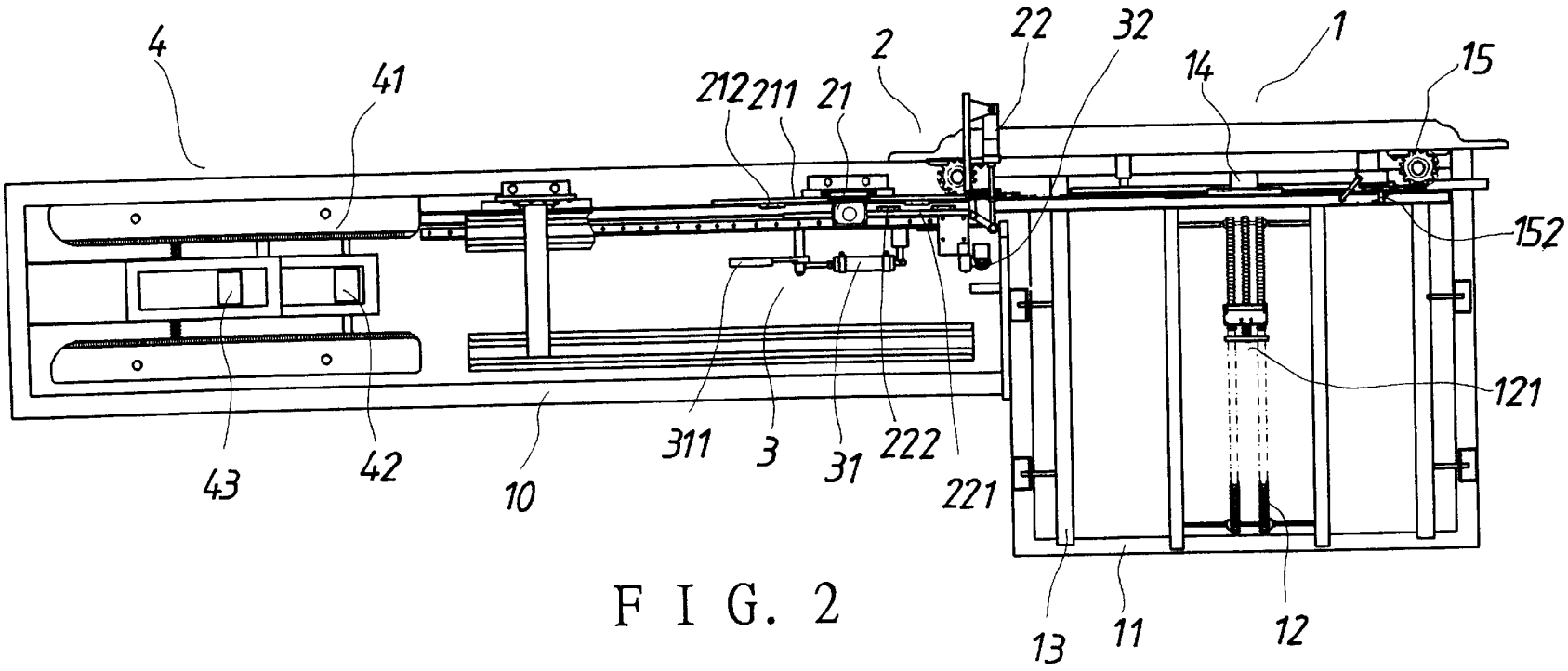
FIG. 2 is an upper view of the carton-shaping machine of the present invention.

A preferred embodiment of a carton-shaping machine of the present invention, as shown in FIGS. 1 and 2, includes a material conveying mechanism 1, an opening mechanism 2, a shaping mechanism 3, and a band sticking mechanism 4 combined on a worktable 10.

The material conveying mechanism 1 has a material support frame 11 located vertical to the operating direction of the worktable 10. A vertical conveyer belt 12 located vertical to the operating direction of the shaping machine. A push plate 121 located on the vertical conveyer belt 12. A guide frame 13 respectively located on the material support frame 11 at two sides. An upper base 14 located above the worktable 10 at an end of the vertical conveyer belt 12. A horizontal conveyer wheel unit 15 respectively located oppositely above and below the upper base 14. A chain 151 extending around the wheel unit 15, and several needle bases 152 shown in FIG. 7 fixed on the chain 151.

The opening mechanism 2 is installed behind the material conveying mechanism 1, having a vertical control cylinder 21 for controlling a fixing member 211 in vertical movement. A plurality of needle bases 212 fixed oppositely on the fixing member 211. A small fixing member 221 fixed on a front end surface by means of a pivot shaft 23. A needle base 222 fixed on a front side of the fixing member 221, and a horizontal control cylinder 22 located behind the fixing member 221 for controlling movement of the fixing member 221.

The shaping mechanism 3 is located on the worktable just below the opening machanism 2, having a first and a second pressure cylinder 31 and 32 for controlling a front and rear push member 311 and 321 in movement. A left and a right side pressure cylinder 33, 33 for moving side push members 331, 331. Further, a rail 34 is provided on the worktable between the two push members 331, 331 for a slide base 35 to ride on, and a vertical push rod 351 is fixed on the slide base 35.

The band sticking mechanism 4 is located behind the shaping mechanism, having two opposite side conveyer belts 41, a roller unit 42 provided between the two side conveyer belts 41, and a band sticker 43 located behind the roller unit 42.

Figure 9:
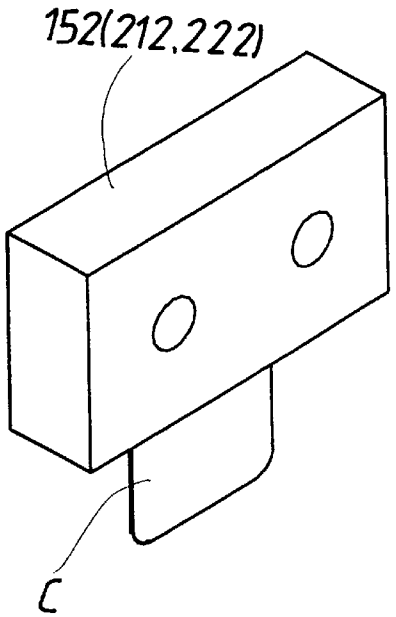
FIG. 9 is a perspective view of a third needle base in the carton-shaping machine of the present invention.
Figure 8:
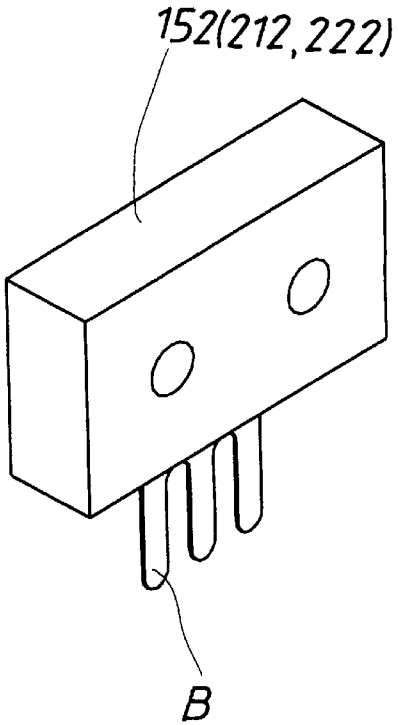
FIG. 8 is a perspective view of a second needle base in the carton-shaping machine of the present invention.
Figure 7:
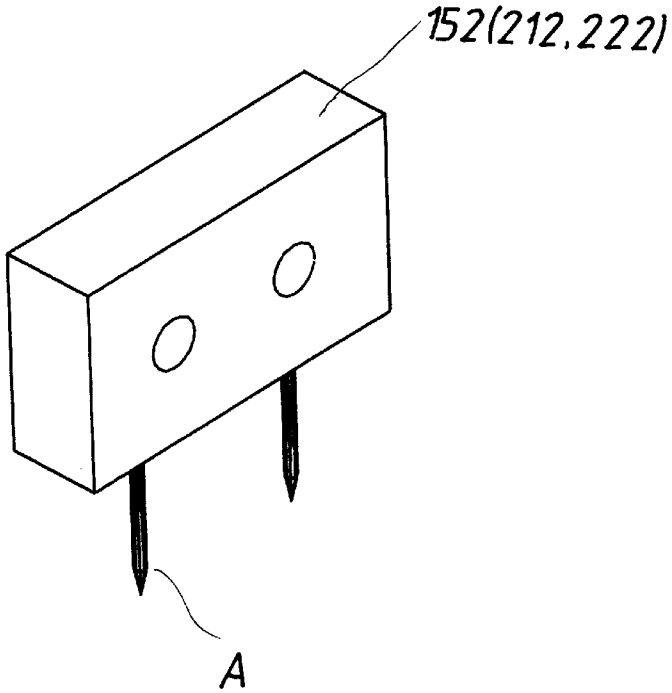
FIG. 7 is a perspective view of a first needle base in the carton-shaping machine of the present invention.
Figure 10:
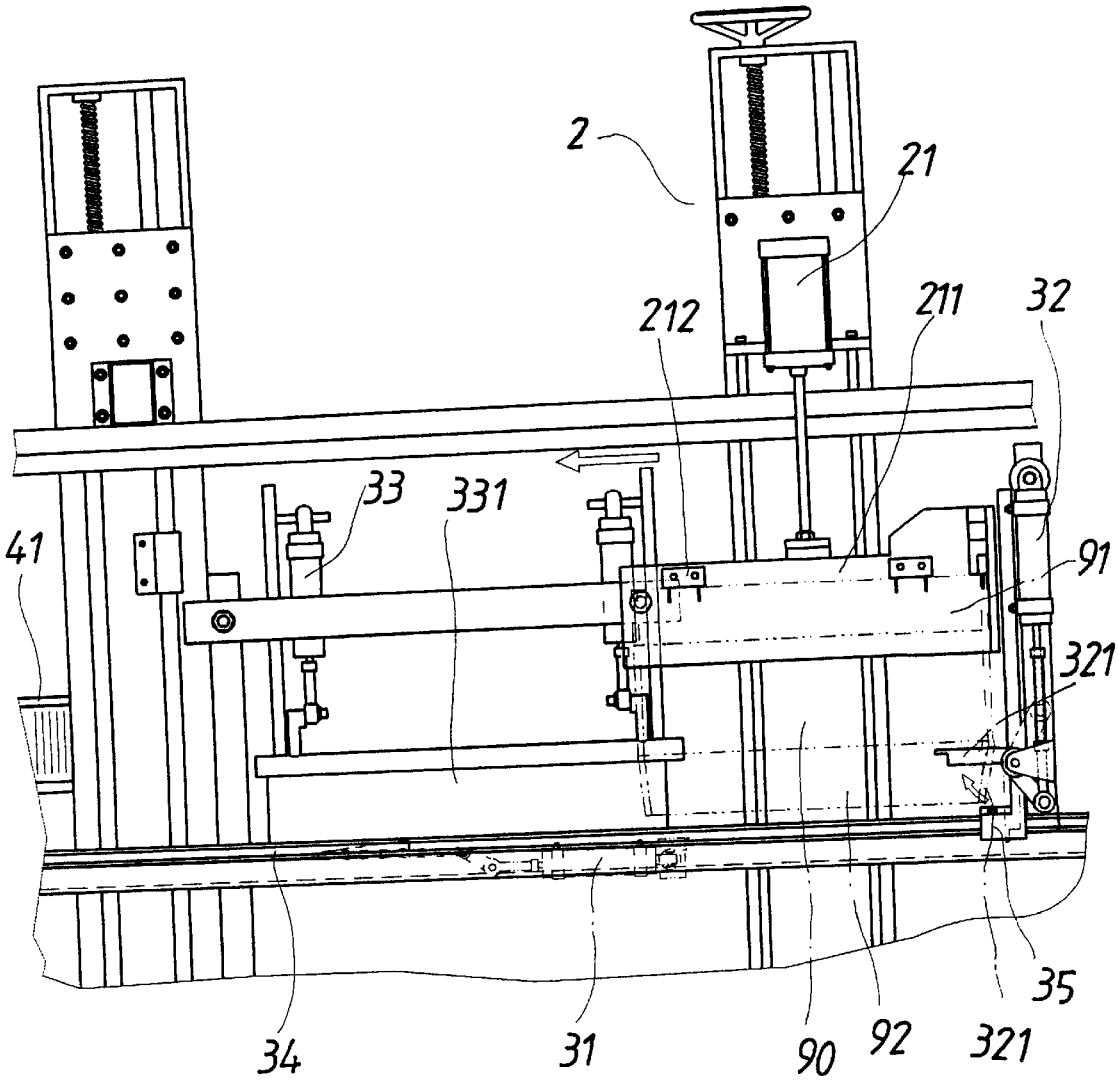
FIG. 10 is a front view of a shaping mechanism being at a first stage of operation in the carton-shaping machine of the present invention.
Figure 11:
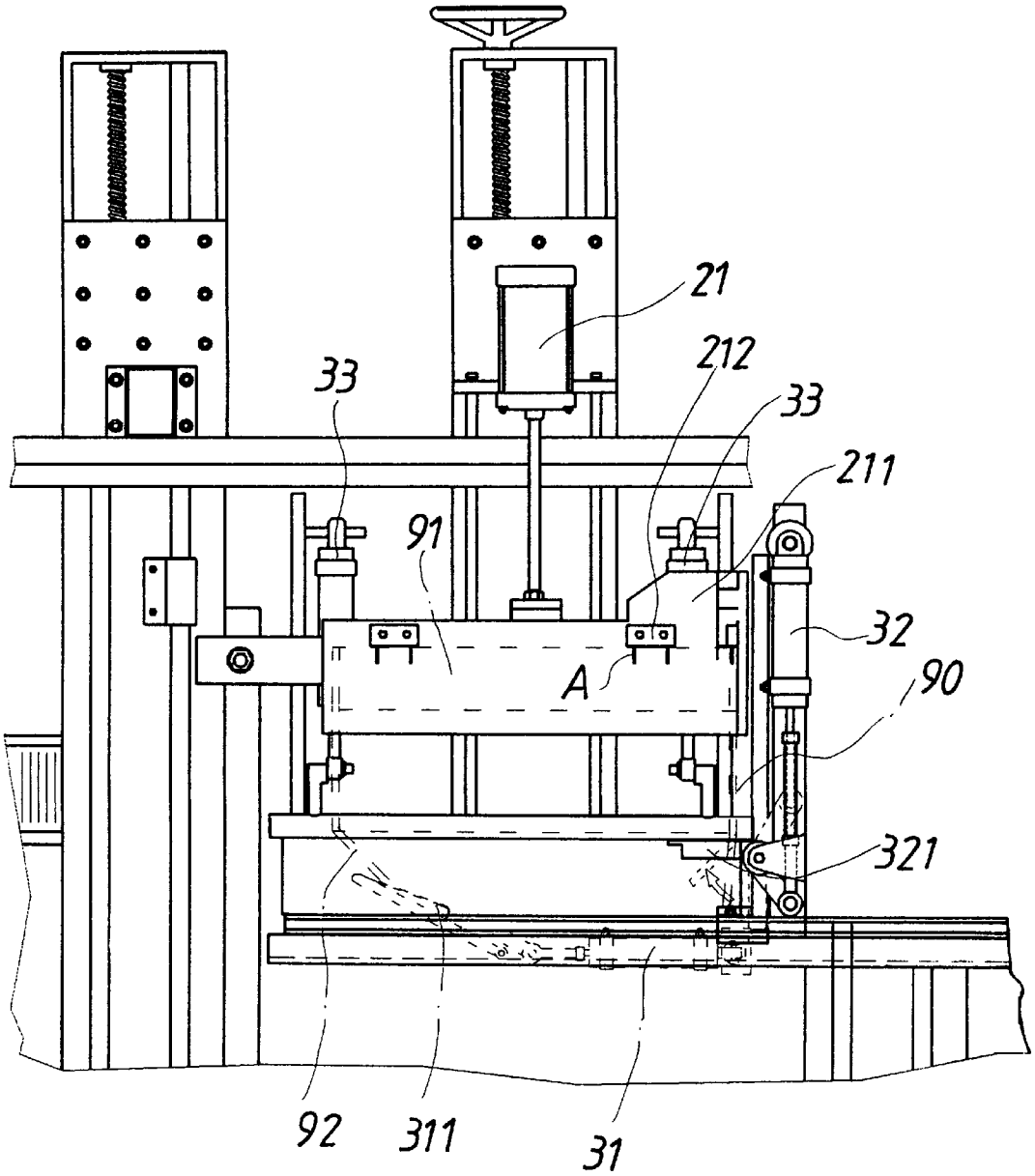
FIG. 11 is a front view of the shaping mechanism being at a second stage of operation in the carton-shaping machine of the present invention.
Figure 12:
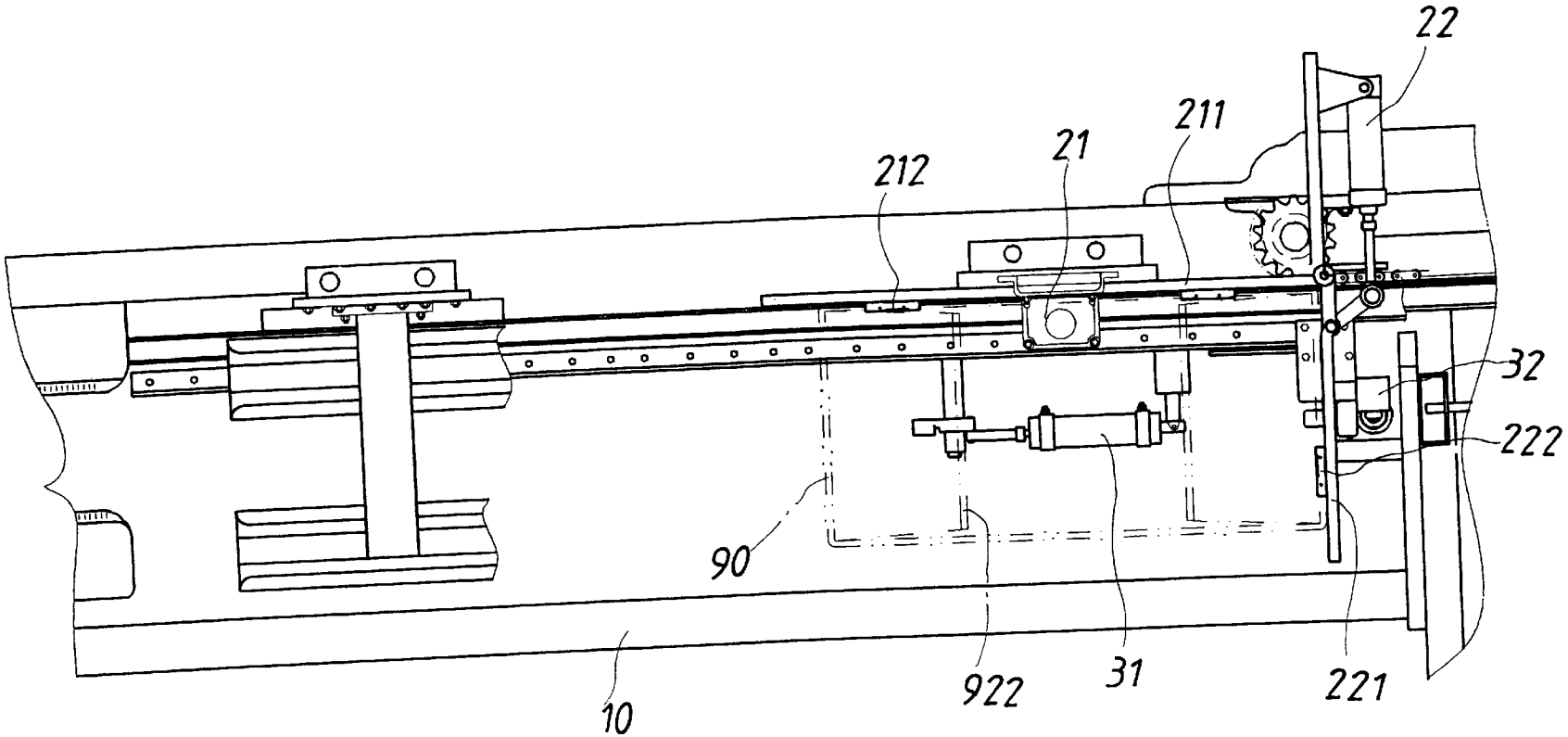
FIG. 12 is an upper view of the shaping mechanism being at the first stage of operation in the carton-shaping machine of the present invention.
Figure 13:
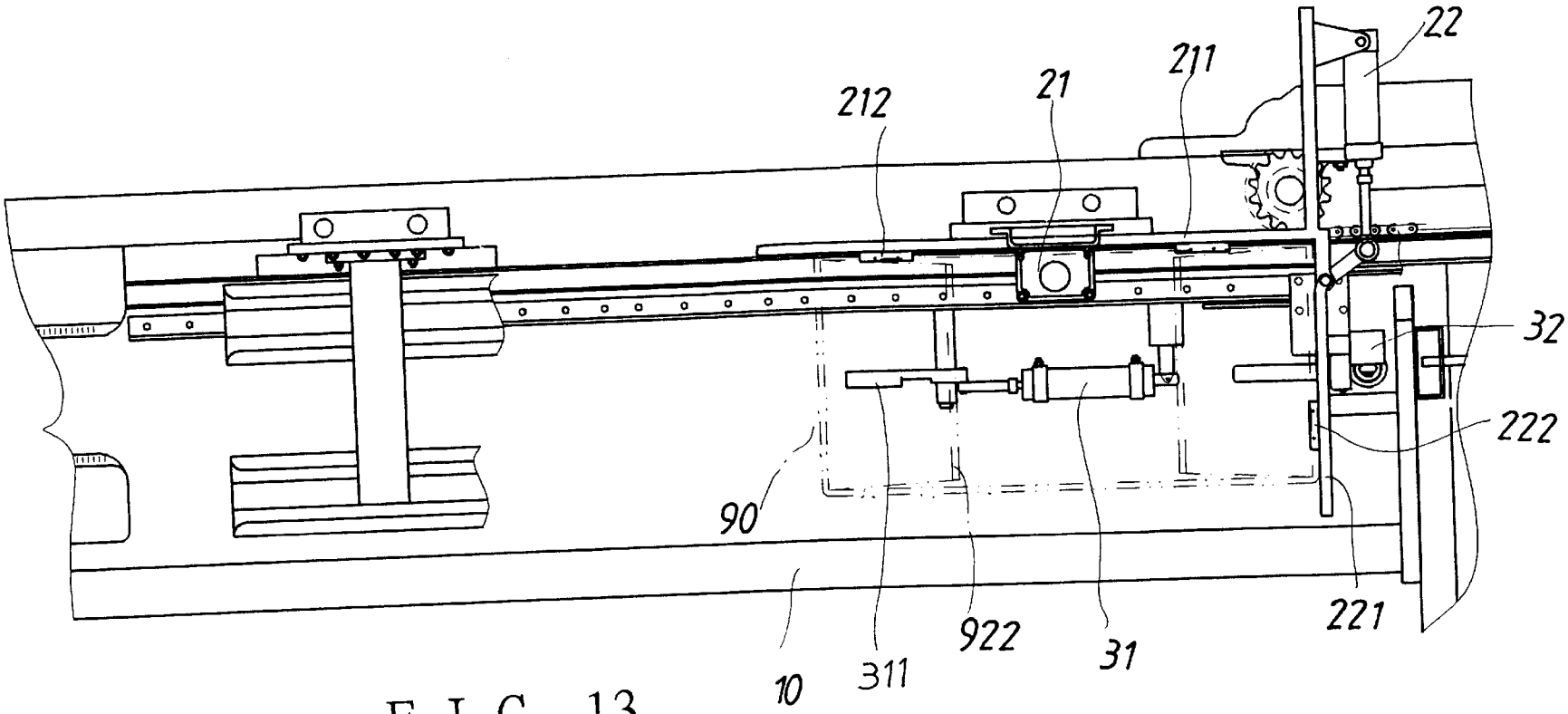
FIG. 13 is an upper view of the shaping mechanism being at the second stage of operation in the carton-shaping machine of the present invention.
Figure 14:
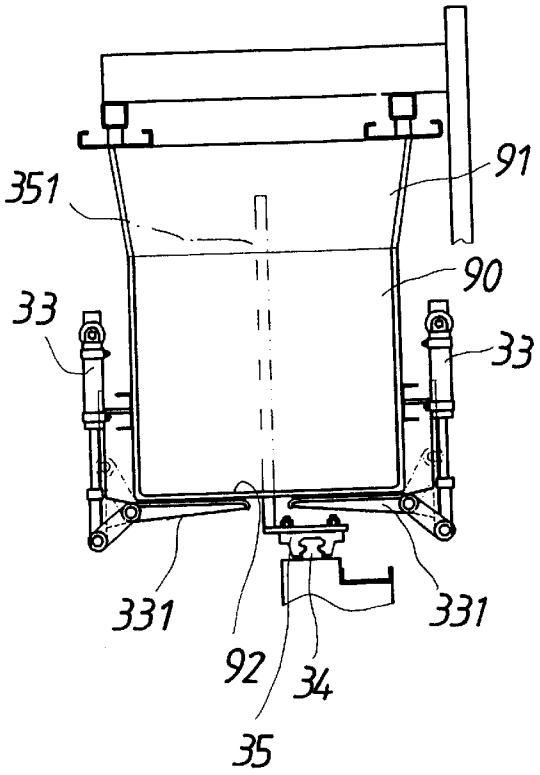
FIG. 14 is a side view of the shaping mechanism being at the first stage of operation in the carton-shaping machine of the present invention.
Figure 15:
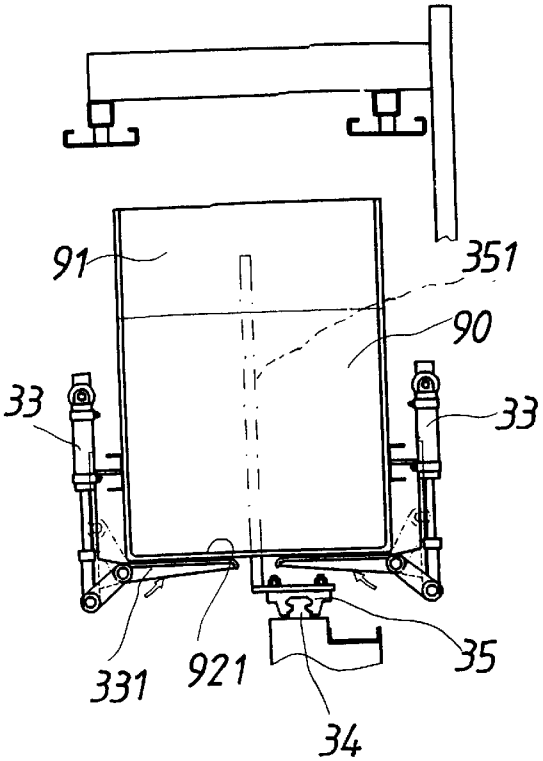
FIG. 15 is a side view of the shaping mechanism being at the second stage of operation in the carton-shaping machine of the present invention.
Figure 17:
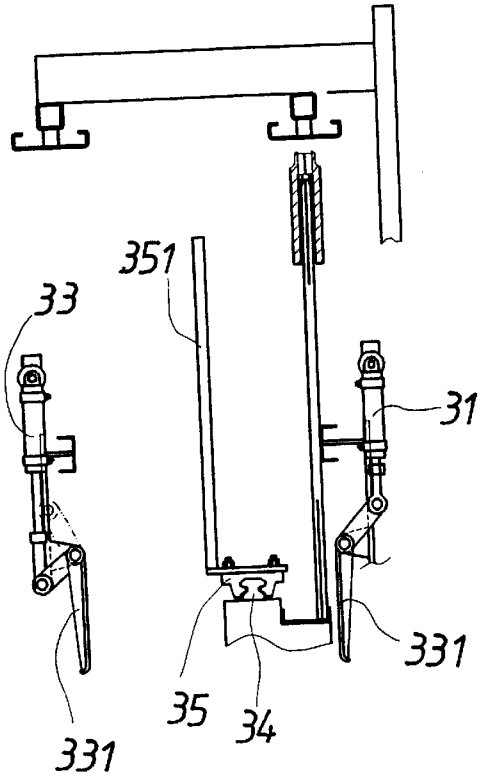
FIG. 17 is a side view of the shaping mechanism being moved in the carton-shaping machine of the present invention.
Figure 16:
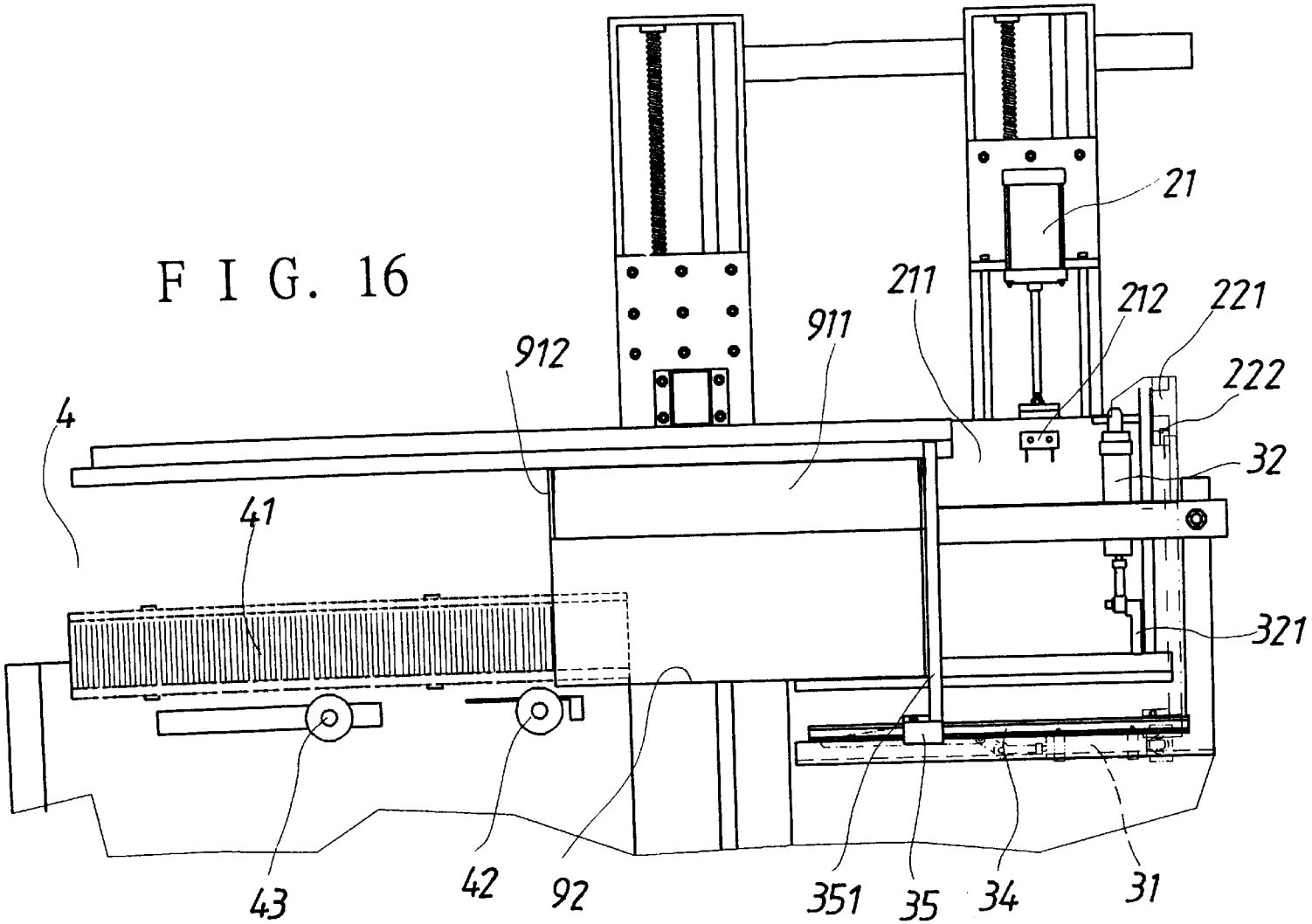
FIG. 16 is a front view of the shaping mechanism being moved in the carton-shaping machine of the present inveniton.
Figure 18:
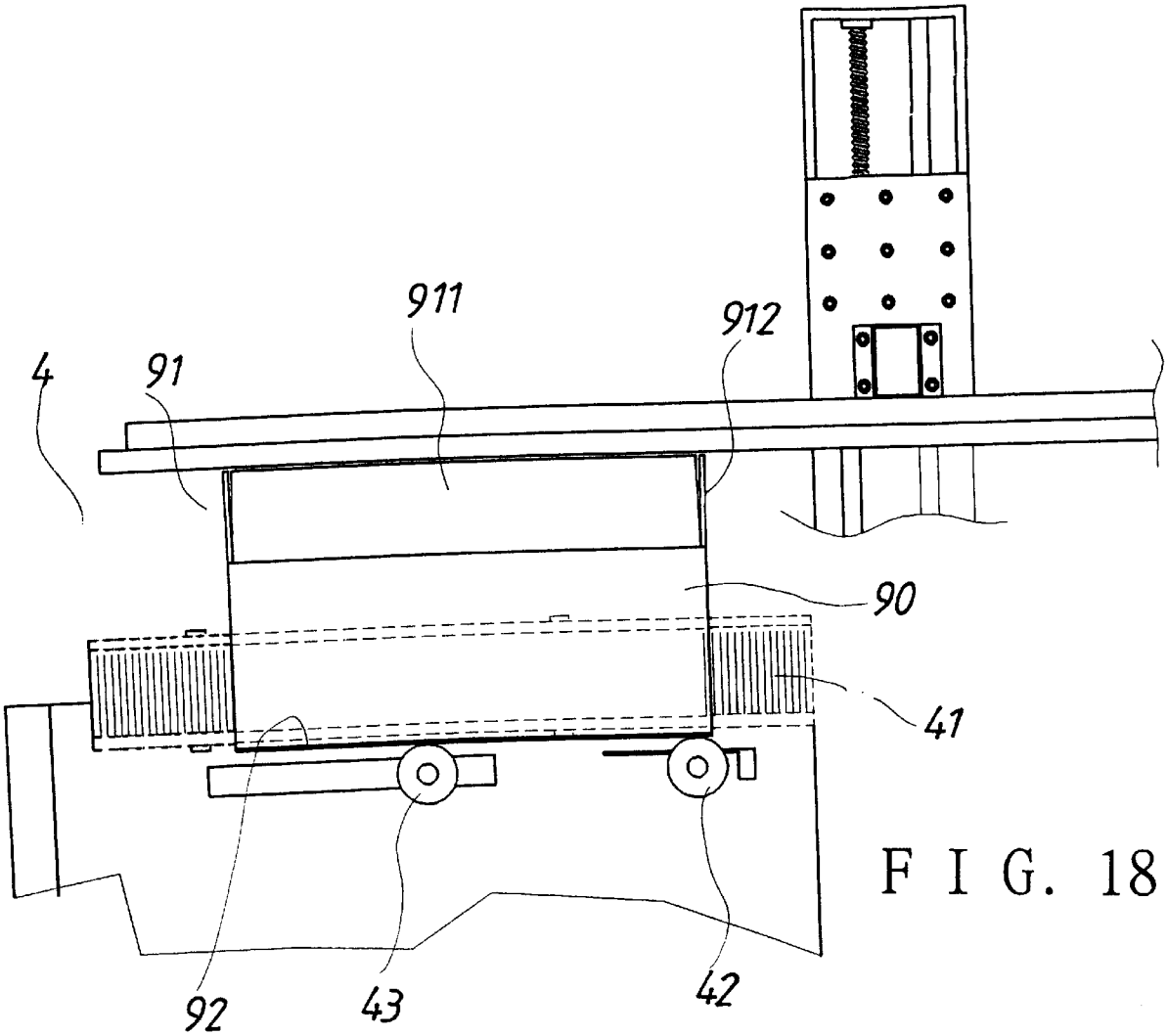
FIG. 18 is a side view of a band sticking mechanism in the carton-shaping machine of the present invention.

The horizontal conveyer wheel unit 15 has a chain 151 and the fixing members 211, 221 all fixed with the needle bases 152, 212, 222 shown in FIG. 7. The needle bases 152,212,222 respectively have a needle A or B of three forks as shown in FIG. 8 or of a plate shape C shown in FIG. 9 or of any shape to suit to practical work.

Figure 3:
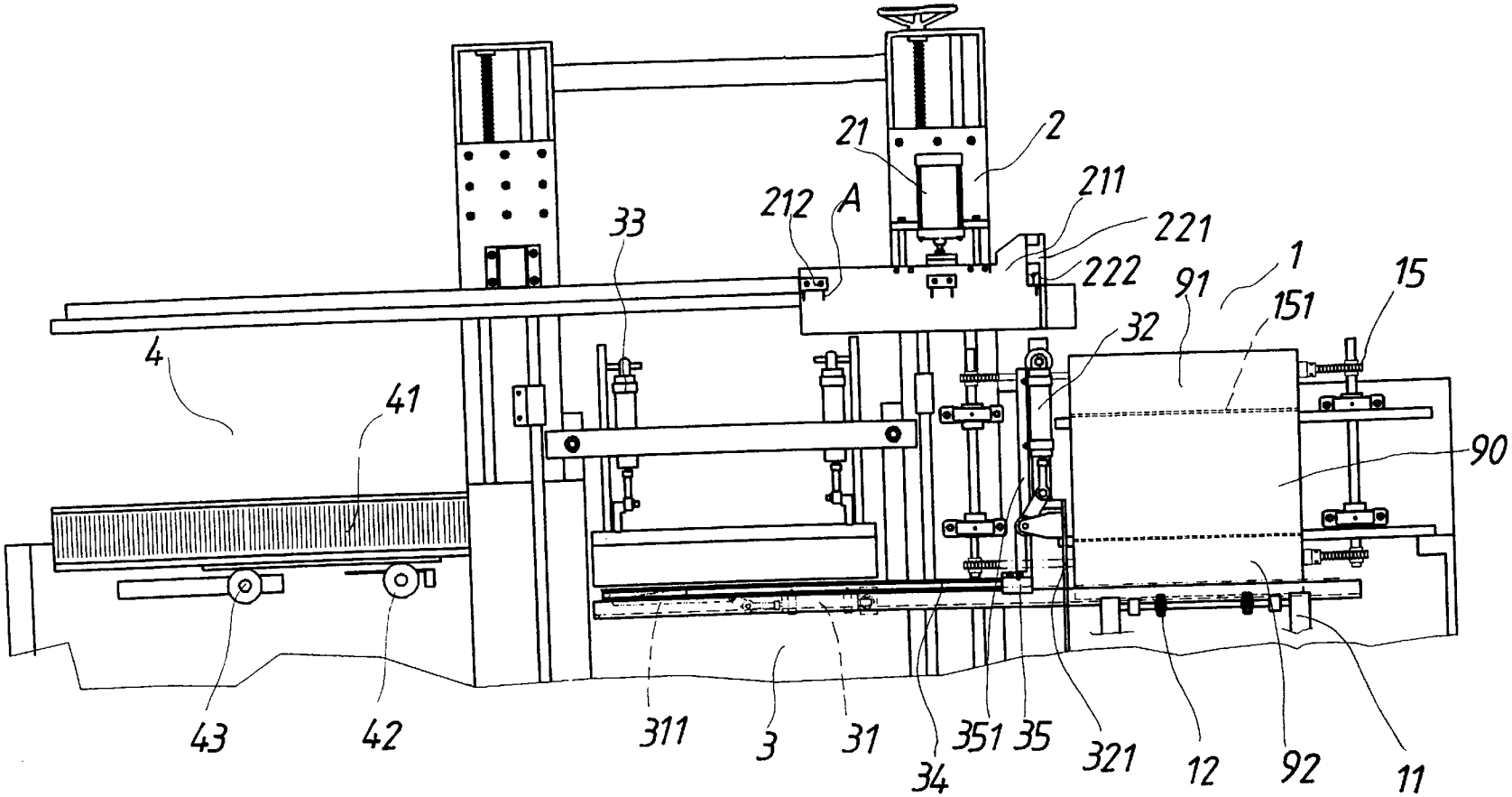
FIG. 3 is a front view of a material conveying mechanism in the carton-shaping machine of the present invention.
Figure 4:
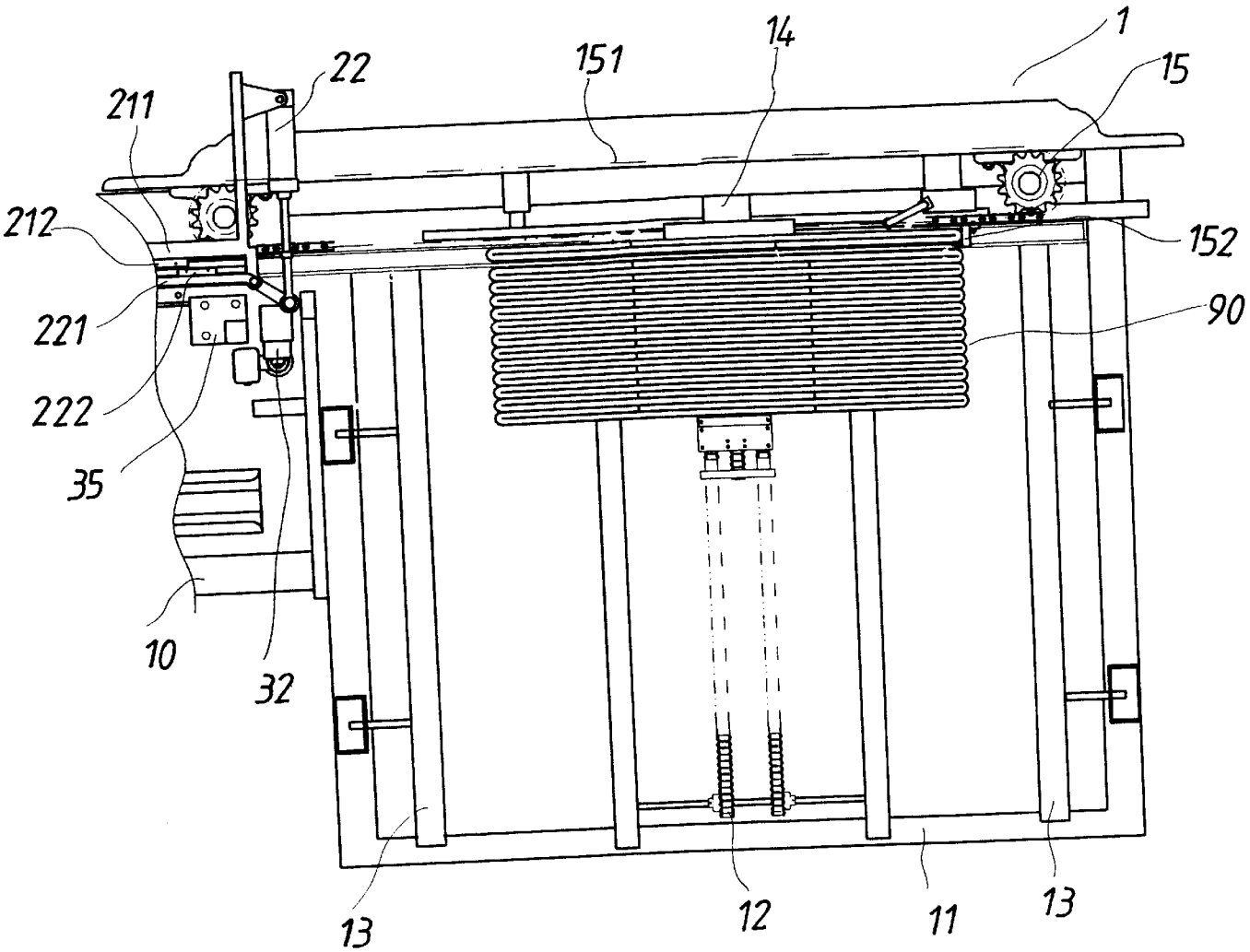
FIG. 4 is an upper view of the material conveying mechanism in the carton-shaping machine of the present invention.
Figure 5:
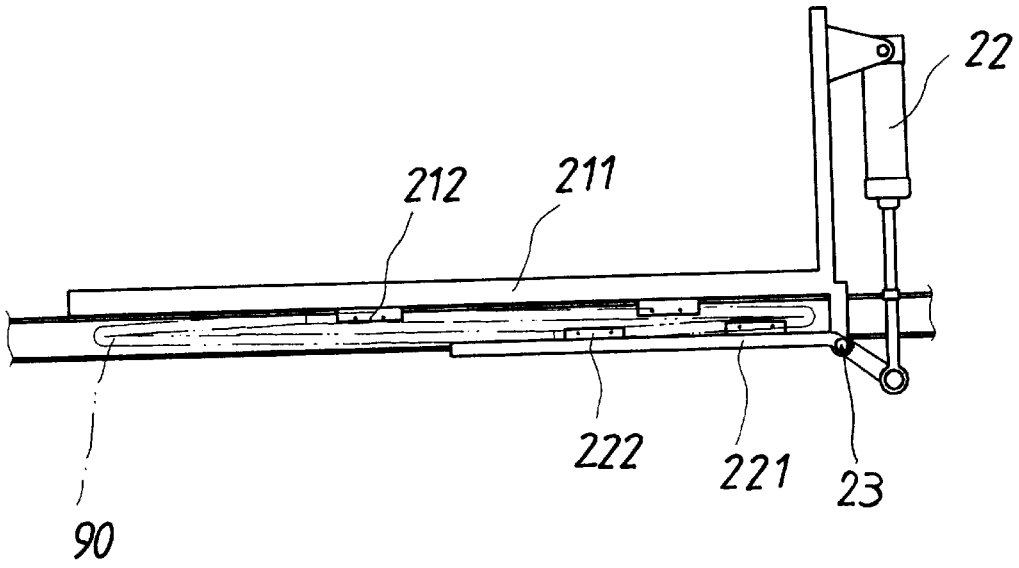
FIG. 5 is a side view of a carton opening mechanism being at a first stage of operating in the carton-shaping machine of the present invention.
Figure 6:
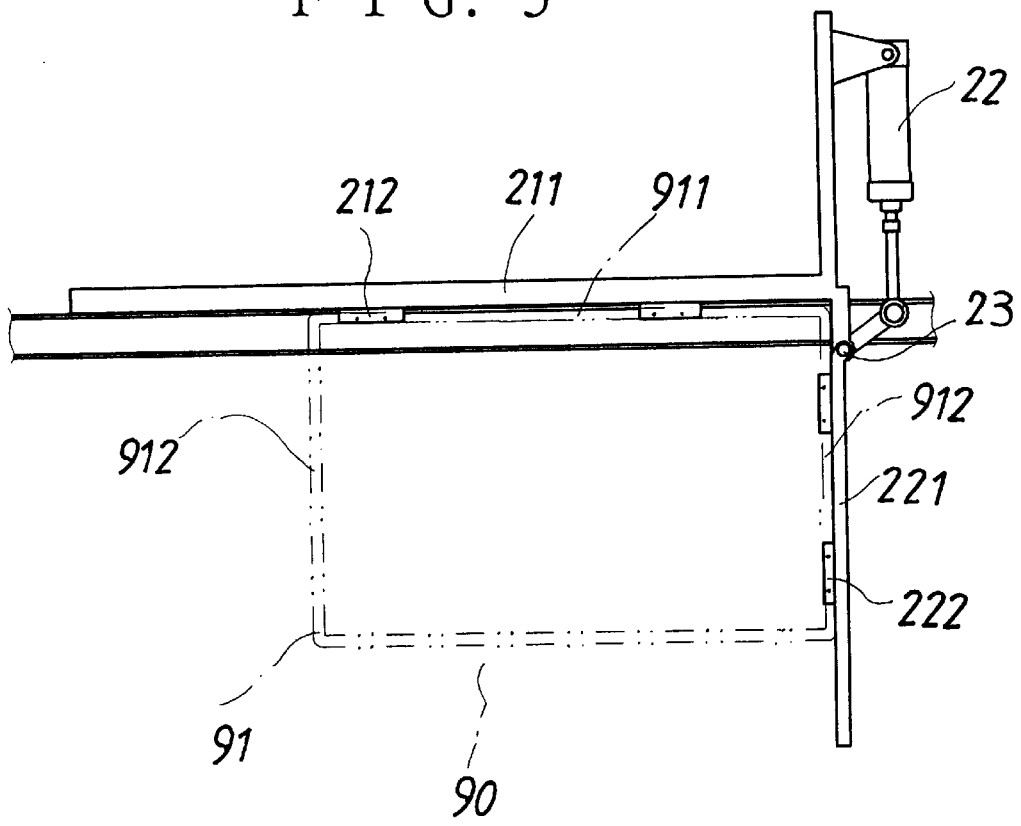
FIG. 6 is a side view of a carton opening mechanism being at a second stage of operating in the carton-shaping machine of the present invention.

When the carton-shaping machine is started to operate, with FIG. 3 are 4 also referred to, cartons 90 and orderly arranged on the material support frame 11. And the vertical conveyer belt 12 intermittently conveys cartons 90 in flat vertical condition, with the push plate 121 on the vertical conveyer belt 12 leads a carton 90 to move forward in conjunction with the guide frame 13, pushing onto the upper base 14. Then the horizontal conveyer wheel units 15, 15 moves the chain 151, 151, with the needles A of the needle bases 152 inserting in the upper end and the lower end of the folding portions 91, 92 of the carton 90. Then, the carton 90 is pushed to under the vertical control cylinder 21, which then moves the fixing members 211, 221 downward, letting the needles A of the needle bases 212, 222 insert in the longitudinal sides 911 and the lateral sides 912. Then, the horizontal control cylinder 22 is operated to turn the fixing member 221 outward 90 degrees with the pivot shaft 23 as a pivot, forcing the carton 90 opened to stand vertically as shown in FIGS. 5 and 6.

Further, the first and the second pressure cylinder 31 and 32 of the shaping mechanism 3 move the front and the rear push member 311 and 321 to fold the two lateral sides 922 of the lower folding portion 92, and then the left and the right pressure cylinder 33 are operated to move the two side push members 331 to fold the two longitudinal sides 921, 921, as shown in FIGS. 10–13. At this time the needle bases 212, 222 with the needles A are separated from the carton 90, moved by the vertical control cylinder 21, with the small fixing member 221 recovering its original position. The front and the rear push member 311 and 321 are no more pushed to fall down, when the first and the second pressure cylinder 31 and 32 finish operation. Then, the slide base 35 moves from its position along the rail 34 forward, with the push rod 351 on the slide base 35 properly pushing the carton 90, which is then gradually moved to the band sticking mechanism 4. Meanwhile, the needle base 152 of the material conveying mechanism 1 separates from the carton 90, and is carried to the standby position by the chain of the horizontal conveyer wheel unit 15. Then, the lower folding portion 92 of the carton 90 gradually separates from the side push members 331, 331. When the carton 90 moves to rest on the two side conveyer belts 41 of the band sticking mechanism 4, the side conveyer belts 41, and the roller unit 42 are started to operate to convey the carton 90 onto the band sticker 43 to be stuck on a band. Meanwhile, the side push members 331 and the slide base 35 are moved back to the original position, ready for the next round of operation, as shown in FIGS. 14–18.

After the carton-shaping machine finished operation one round, a carton is in a standing position with the bottom folding portion already sealed with a band, and the carton is on the way to the packing department for packing, without any need of manual work and turning cartons to stand-up position. In addition, the opening mechanism may not make erroneous operation as the known conventional shaping machines, permitting the carton-shaping machine in the invention operate effectively and correctly.

What is claimed is:

1. A carton-shaping machine comprising a material conveying mechanism, an opening mechanism, a shaping mechanism and a band sticking mechanism combined on a worktable;

said material conveying mechanism having a material support frame located slopingly perpendicular to an operation direction on said worktable, a vertical conveyer belt fixed on a center portion of said material support frame located perpendicular to said operation direction of said shaping machine, a push plate located above said vertical conveyer belt, a guide frame respectively located at two sides of said push plate and above said material support frame, an upper base located at an upper end of said vertical conveyer belt and on said worktable, and a horizontal conveyer wheel unit for driving two chains respectively located above and below said upper base to convey a vertically arranged carton in said operation direction;

said shaping mechanism having a first and a second pressure cylinder located horizontal below said opening mechanism for controlling respectively a front and a rear push member, a left and a right pressure cylinder located at two sides of said first and said second pressure cylinder for moving a side push member, a rail located between said two side push members for a slide base to lie and move thereon, and a vertical push rod fixed on said slide base;

said band sticking mechanism located behind said shaping mechanism, having a side conveyer belt respectively located at two longitudinal sides on said worktable, a roller unit located between said two side conveyer belts, and a band sticker at a rear portion of said band sticking mechanism;

said opening mechanism located behind said meterial conveying mechanism, having a vertical control cylinder for controlling a fixing member in vertical movement, a plurality of needle bases with a downward needle fixed on said fixing member, a small fixing member pivotally connected to said fixing member with a pivot shaft, said small fixing member having a needle base fixed on its front side, a horizontal control cylinder located behind said fixing member, wherein needles of said needle bases inserting in an upper folding portion of a carton when said opening mechanism is operating for opening said upper folding portion of said carton in standing position.

2. The carton-shaping machine as claimed in claim 1, wherein said two chains of said material conveying mechanism have a plurality of needle bases corresponding to each other to position the upper and the lower end of side portions of a carton.

3. The carton-shaping machine as claimed in claim 1, wherein said needle bases respectively have a three-fork needle or a plate needle extending downward.

* * * * *